US006247992B1

(12) United States Patent
Higgins, III

(10) Patent No.: US 6,247,992 B1
(45) Date of Patent: Jun. 19, 2001

(54) FINGER ATTACHMENT DEVICE FOR HOLDING AND CONTROLLING A YO-YO TYPE TOY

(76) Inventor: William Higgins, III, 1172 Eastwood Ave., Mayfield Heights, OH (US) 44124

( * ) Notice: Subject to any disclaimer, the term of this patent is extended or adjusted under 35 U.S.C. 154(b) by 0 days.

(21) Appl. No.: 09/510,071

(22) Filed: Feb. 22, 2000

Related U.S. Application Data

(60) Provisional application No. 60/121,690, filed on Feb. 25, 1999.

(51) Int. Cl.[7] ..... A63H 1/30
(52) U.S. Cl. ..... 446/250
(58) Field of Search ..... 446/250; 24/16 R, 24/16 PB, 713.6

(56) References Cited

U.S. PATENT DOCUMENTS 1,864,318 * 6/1932 Powell ..... 446/250
4,112,988 * 9/1978 Nelson ..... 24/16 PB X
5,056,664 * 10/1991 Demers ..... 24/16 R
5,470,269 * 11/1995 Ambroz ..... 446/250
5,979,184 * 11/1999 Razza ..... 446/250 X
6,113,456 * 9/2000 Hadzicki et al. ..... 446/250

* cited by examiner

*Primary Examiner*—John A. Ricci
(74) *Attorney, Agent, or Firm*—Kelly Bauersfeld Lowry & Kelley, LLP

(57) ABSTRACT

A device for attachment of a yo-yo type toy to a finger is provided which has a durable eyelet reinforced leather strap of sufficient length to wrap at least half way around the finger when attached to a string of the yo-yo. The string is connected to the device when a reduced size slipknot is created and passed through the eyelets before closing therefore enclosing the eyelets in the adjustable loop of the slip knot. When the finger is inserted outside of the loop of the slip knot between the outside top of the slip knot and the device and the slip knot is constricted, the eyelets are pulled together causing the invention to constrict around the finger providing a stable attachment to the finger.

14 Claims, 6 Drawing Sheets

FINGER ATTACHMENT DEVICE FOR HOLDING AND CONTROLLING A YO-YO TYPE TOY

This application claims priority from provisional application Serial No. 60/121,690 filed Feb. 25, 1999.

BACKGROUND OF THE INVENTION

This invention relates to devices for holding or controlling a toy. More particularly, the present invention relates to a finger attachment device for holding and controlling a yo-yo.

For many years and in many cultures the bandolier, or yo-yo as it is more commonly known, has been a popular toy. Recently, there has been a resurgence in the popularity of the yo-yo. Many of the newer yo-yo's have an appearance designed to be visually striking and have become fashion accessories as well as toys. A yo-yo may be crafted out of many different materials, and while the basic construction of the yo-yo is simple, there are a number of variations on the overall design that have been created and sold to the general public. Throughout these variations, however, the designers have consistently used a string of some sort to allow the user of the yo-yo to hold and control the toy. The string is attached at one end to the yo-yo and at the other end to the user of the toy traditionally by way of a slip knot tied around a finger.

While the use of the slip knot connection has been the most common way one holds and controls the yo-yo, there are inherent problems in using a string tied to a finger. For example, the slip knot has a natural tendency to become tighter and tighter around the user's finger during use, thus cutting off circulation and making the user uncomfortable. Due to the small size of the slip knot, the entire string can become pulled into the slot of the yo-yo. Further, the slip knot itself can become tangled around itself or the yo-yo; or, it may become untied, forcing the user to untangle or re-tie the knot to continue using the toy.

Accordingly, there is a need for a connector or holder for a yo-yo which will significantly improve circulation in the user's fingers when the toy is being used. There is also a need to provide a connector or holder for a yo-yo which will remain tangle-free during use. Furthermore there is a need for such a connector or holder which will prevent the toy from becoming useless due to the string becoming tangled or being pulled into the inner hub or housing member of the yo-yo. The present invention fulfills these needs and provides other related advantages.

SUMMARY OF THE INVENTION

The present invention resides in a finger attachment device for holding and controlling a yo-yo type toy. A typical yo-yo comprises a disc rotatable about a major axis of a central axle which is accessible through a peripheral slot of the disc. A first end of a string is secured to the axle and a second end of the string is attachable to a finger of the user. The inventive device generally comprises a harness including an elongated, flexible strap which has apertures through opposite ends thereof for attachment to the second end of the string so that the tightening of the harness about the user's finger is limited to the length of the harness between the apertures.

The harness is preferably comprised of leather and bends around the user's finger to surround at least one-half of the finger's circumference. Durable ring eyelets are attached to the strap and define the apertures so as to protect the strap from unnecessary wear from the attached string.

The harness is permanently attached to the string by means of a slip knot through which the first end of the string is passed through before being secured to the axle. The string adjacent to the knot is adjustable to facilitate insertion of the user's finger into and removal from the harness.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
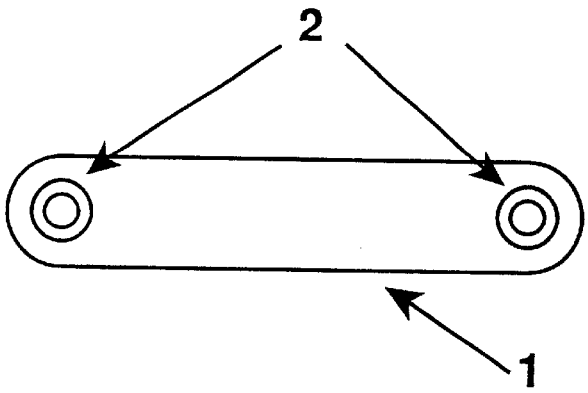
FIG. 1 is a top plan view of a finger attachment device embodying the present invention.

As shown in the drawings for purposes of illustration, the present invention is concerned with a finger attachment harness to hold and control a yo-yo type toy 8.

Figure 2:
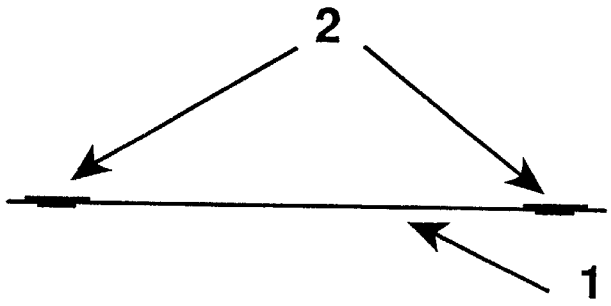
FIG. 2 is a side view of the device of FIG. 1.

As shown in FIGS. 1 and 2 the harness comprises a strap 1, preferably comprised of leather, having a length which allows the strap 1 to wrap at least half way around a circumference of a user's finger 4. Apertures defined by eyelets 2 are formed adjacent opposing ends of the strap 1. The eyelets 2 are comprised of a durable material, such as metal so as to prevent unnecessary wear from an attached yo-yo string 3.

Figure 3A:
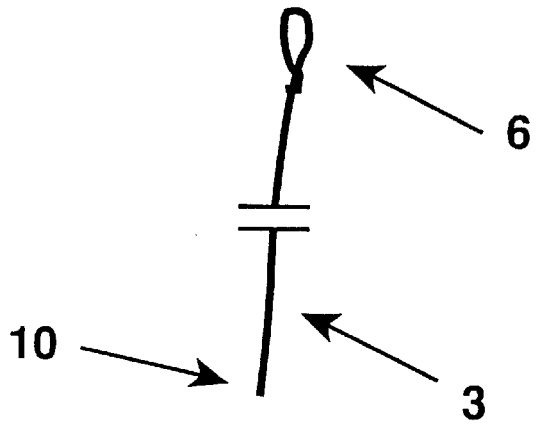
FIG. 3*a* is a schematic elevational view of a string having a slip knot with a fixed loop.
Figure 3B:
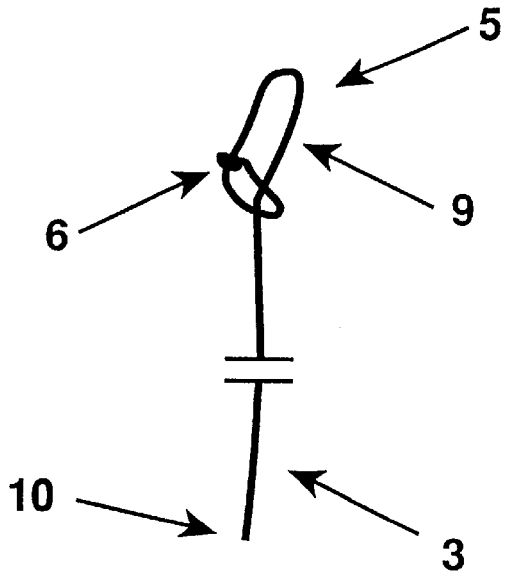
FIG. 3*b* is a schematic elevational view of the string and slip knot of FIG. 3*a* having the fixed loop as well as an adjustable loop.
Figure 6:
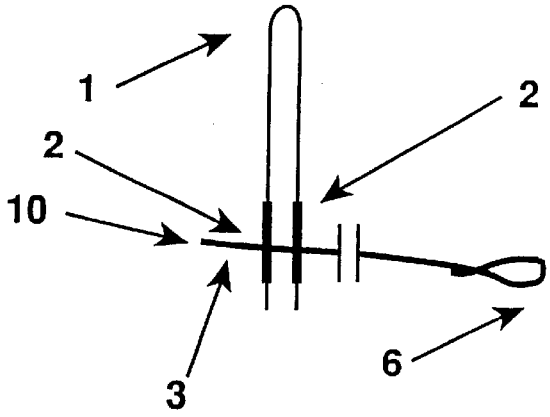
FIG. 6 is an elevational view of the device depicting the first step of connection of the string to the device.
Figure 7:
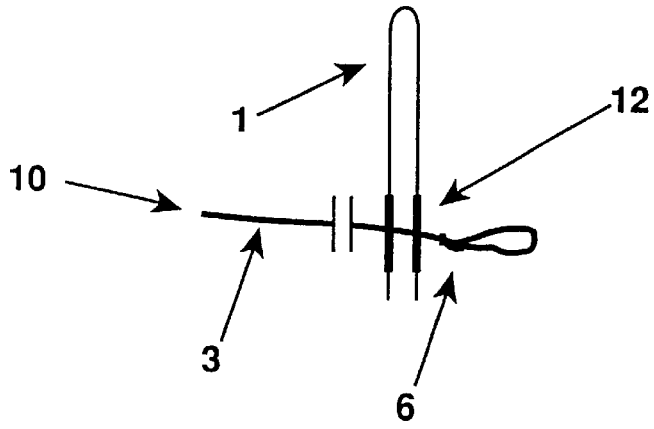
FIG. 7 is an elevational view similar to FIG. 6, depicting a second step of connection of the string to the device.
Figure 8:
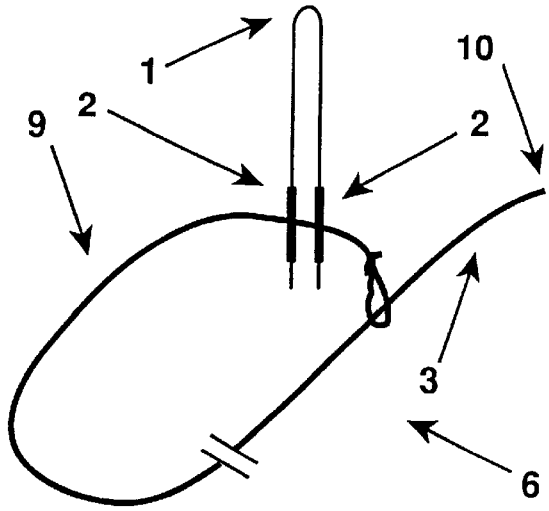
FIG. 8 is an elevational view of similar to FIGS. 6 and 7, depicting a third step of connection of the string to the device.

To properly attach the string 3 to the strap 1, a second end 6 of the string 3 is first formed into a reduced size slip knot having a fixed loop, as shown in FIG. 3*a*. The strap 1 is folded so that the eyelets 2 are aligned and the first end 10, the yo-yo end, of the string 3 is then threaded through the eyelets 2 of the leather strap until the slip knot and fixed loop 6 lie adjacent to or contact the eyelet at position 12 preventing further travel of the string 3, as illustrated in FIGS. 6 and 7. The first end of the string 10 is then brought around and threaded through the open fixed loop of the slip knot 6 to form an adjustable loop 9, as illustrated in FIGS. 3*b* and 8.

Figure 9:
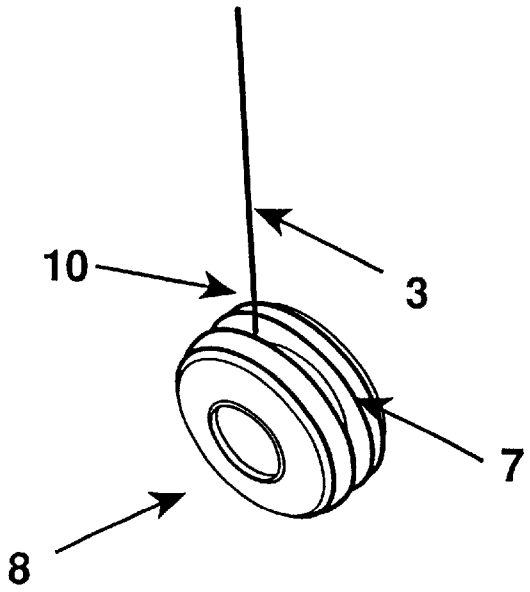
FIG. 9 is a perspective view of a yo-yo attached to a string.

As shown in FIG. 9, the first end 10 of the string 3 is passed into a slot 7 formed within the disc of the yo-yo 8 and attached to a center axle (not shown) of the yo-yo 8. As is well known in the art, the disc of the yo-yo is rotatable along the primary axis of the central axle.

Figure 4:
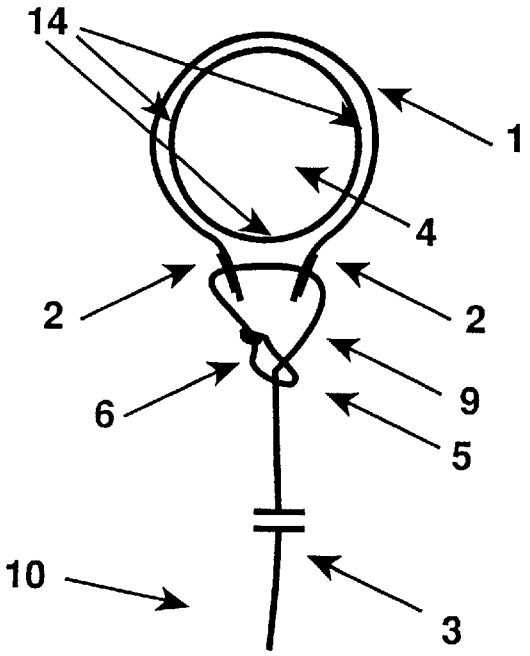
FIG. 4 is an end view of the string and knot of FIG. 3*b* attached to the device of FIG. 1, which is secured to a user's finger.

The operation of the invention for holding or controlling the yo-yo type toy 8 should now be apparent to those skilled in the field. From an inspection of FIGS. 4, 5*a* and 5*b*, it is seen that the user's finger 4 is passed through the opening 14 between the strap 1 of the harness and the adjustable loop 9 portion of the slip knot, thus creating a closed loop made up of the string 3 and the harness. Once this connection is made, the user can hold and control the yo-yo type toy 8.

Figure 5A:
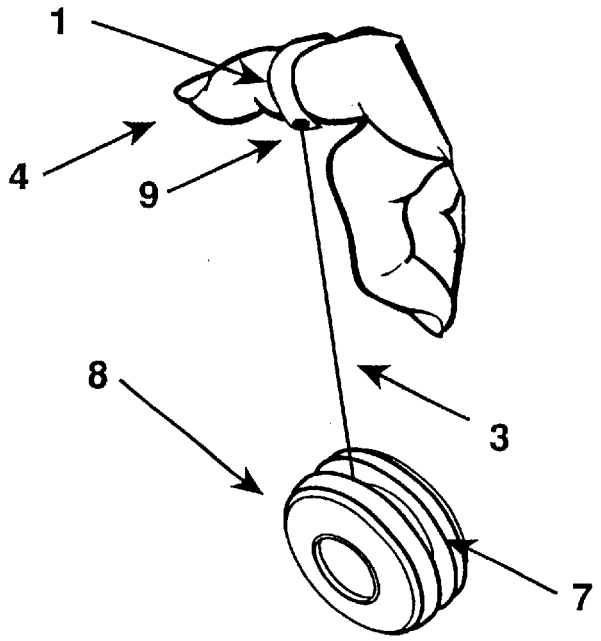
FIG. 5*a* is a perspective view of a device embodying the present invention securely wrapped about a finger of a user and connected to a yo-yo, such that the downward motion of the yo-yo creates tension in the string and the device tightly forms around the user's finger.
Figure 5B:
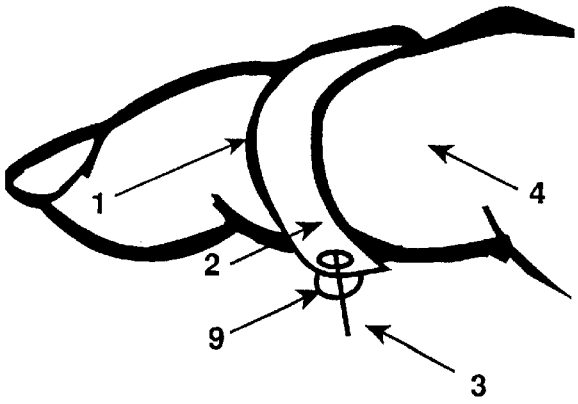
FIG. 5*b* is an enlarged perspective view similar to FIG. 5*a*, illustrating ends of the device brought close together due to the tension in the string.

In the past, only a string was used to hold or control a yo-yo type toy. The tension on the string created when the yo-yo was thrown downwardly acted to increasingly close the traditional yo-yo slip knot around the user's finger causing loss of circulation and discomfort. This is avoided when using the device of the present invention as when the yo-yo type toy 8 is thrown downwardly and the string 3 becomes taught, as shown in FIG. 5*a*, the tension of the string 3 is spread over the large surface area of the strap 1. This tension causes the eyelets 2 of the strap 1 to come together and comfortably secure the device to the finger 4, as illustrated in FIG. 5*b*. The tension applied to the finger 4 can be increased by shortening the length of the strap 1 or reduced by lengthening the strap 1. As the strap 1 constricts and stretches slightly during the downward travel of the yo-yo 8, it is naturally inclined to separate somewhat and return to its normal shape due to its resilient qualities, thus assisting the user in the upward return of the yo-yo toy 8.

Figure 10:
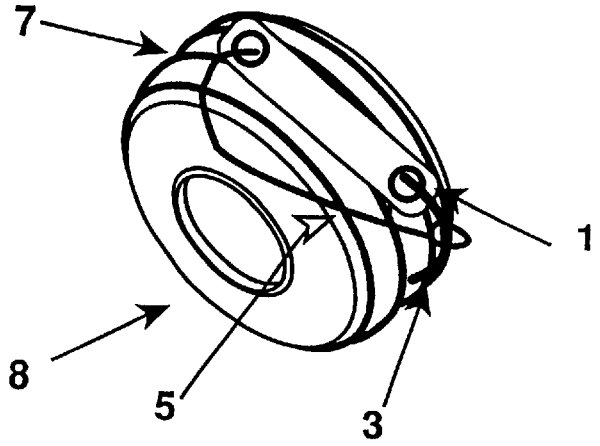
FIG. 10 is a perspective view of a string attached to a yo-yo at one end and the device of the present invention attached at the opposite end so as to prevent the string from completely entering a slot of the yo-yo.

Another problem commonly encountered in the past with yo-yo's is that the string 3 frequently became tangled around the toy's center axle or was completely pulled into the slot 7 of the yo-yo type toy 8, thus rendering it useless. As shown in FIG. 10 the string 3 is prevented from being completely pulled into the slot 7 of the yo-yo 8 due to the physical size of the device 1 versus the width of the slot 7 in the yo-yo type toy 8. Thus, a user can wind the string 3 tightly about the axle of the yo-yo 8 without fear that the string 3 will be pulled into the slot 7 or otherwise tangled with the yo-yo 8.

Although an embodiment has been described in detail for purposes of illustration, various modifications may be made without departing from the scope and spirit of the invention. Accordingly, the invention is not to be limited, except as by the appended claims.

What is claimed is:

1. A finger attachment device for holding and controlling a yo-yo type toy which includes a disc rotatable about a major axis of a central axle which is accessible through a peripheral slot of the disc, and a string having a first end secured to the axle and a second end attachable to a finger of a user, the device comprising:

a harness including an elongated flexible strap having apertures through opposite ends thereof for attachment to the second end of the string, whereby the tightening of the harness about the user's finger is limited to the length of the harness between the apertures, and wherein the string is permanently attached to the harness by means of a knot.

2. The device of claim 1, wherein the harness bends around the user's finger to surround at least one-half of the finger's circumference.

3. The device of claim 1, wherein the strap is comprised of leather.

4. The device of claim 1, including durable ring eyelets attached to the strap and defining the apertures so as to protect the strap from unnecessary wear from the attached string.

5. The device of claim 1, wherein the knot comprises a slip knot through which the first end of the string is passed through before being secured to the yo-yo type toy.

6. The device of claim 5, wherein the string adjacent the knot is adjustable to facilitate insertion of the user's finger into and removal from the harness.

7. A finger attachment device for holding and controlling a yo-yo type toy which includes a disc having a central axle accessible through a peripheral slot of the disc and a string having a first end secured to the axle and a second end attachable to a finger of a user, the device comprising:

a harness including an elongated flexible leatherstrap having durable ring eyelets which define apertures extending through opposite ends of the strap for attachment to the second end of the string;

wherein the harness bends around the user's finger to surround at least one-half of the finger's circumference; and wherein the string is permanently attached to the harness by means of a slip knot, the first end of the string being passed through the slip knot before being secured to the yo-yo type toy so that the portion of the string adjacent the knot is adjustable to facilitate insertion of the user's finger into and removal from the harness;

whereby the tightening of the harness about the user's finger is limited to the length of the harness between the apertures.

8. A yo-yo type toy, comprising:

a disc having a peripheral slot which accesses a central axle of the disc;

a string having a first end secured to the axle; and a harness including an elongated flexible strap having apertures extending through opposite ends of the strap for attachment to a second end of the string;

whereby the tightening of the harness about a user's finger while the yo-yo type toy is held or controlled is limited to the length of the harness between the apertures.

9. The toy of claim 8, wherein the harness bends around the user's finger to surround at least one-half of the finger's circumference.

10. The toy of claim 8, wherein the strap is comprised of leather.

11. The toy of claim 8, including durable ring eyelets attached to the strap and defining the apertures so as to protect the strap from unnecessary wear from the attached string.

12. The toy of claim 8, wherein the string is permanently attached to the harness by means of a knot.

13. The toy of claim 12, wherein the knot comprises a slip knot through which the first end of the string is passed through before being secured to the axle.

14. The toy of claim 13, wherein the string adjacent the knot is adjustable to facilitate insertion of the user's finger into and removal from the harness.

* * * * *